US007484981B2

(12) United States Patent
Garcia et al.

(10) Patent No.: US 7,484,981 B2
(45) Date of Patent: Feb. 3, 2009

(54) ASSEMBLY FOR SEALING AN AUDIO CONNECTOR WITHIN AN ELECTRONIC DEVICE

(75) Inventors: Jorge L. Garcia, Plantation, FL (US); Travis R. Coleman, Sunrise, FL (US); Christopher D. Crawford, Hollowood, FL (US); Chee Hian Lee, Alor Star (MY); David H. McClintock, Georgetown (MY); Kin Fatt Phoon, Ipoh (MY)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/670,268

(22) Filed: Feb. 1, 2007

(65) Prior Publication Data

US 2008/0188107 A1 Aug. 7, 2008

(51) Int. Cl.
*H01R 13/52* (2006.01)

(52) U.S. Cl. ..... 439/271

(58) Field of Classification Search ..... 439/271–276, 439/76.1

See application file for complete search history.

(56) References Cited

U.S. PATENT DOCUMENTS 4,522,211 A * 6/1985 Bare et al. ..... 600/392
4,687,266 A * 8/1987 Tanii et al. ..... 439/77
5,338,213 A * 8/1994 Oko ..... 439/148
5,607,791 A * 3/1997 Garcia et al. ..... 429/96
6,227,872 B1 * 5/2001 Stephenson et al. ..... 439/76.1
6,320,128 B1 * 11/2001 Glovatsky et al. ..... 174/548
6,439,898 B2 * 8/2002 Chua et al. ..... 439/81
2006/0154533 A1 * 7/2006 Higashiguchi et al. ..... 439/835

FOREIGN PATENT DOCUMENTS

JP 09129301 A1 5/1997
JP 11146046 A1 5/1999
JP 13176590 A1 6/2001
JP 13351747 A1 12/2001
JP 13250629 A1 9/2002

* cited by examiner

*Primary Examiner*—Chandrika Prasad
(74) *Attorney, Agent, or Firm*—Barbara R. Doutre

(57) ABSTRACT

A submersible electrical connector assembly (300) includes an electrical connector (301) mounted to a first substrate (309) where a second substrate (311) adjoins the first substrate (309). The second substrate (311) is comprised of a pliable material that acts as a seal. The first substrate and second substrate are positioned within a compartmentalized area of an electrical device housing for preventing water or other fluid from entering an aperture within the housing. Although water may inadvertently enter the electrical connector (301), the connector assembly (300) is substantially submersible since water is prevented from entering the housing (400) as used for an electronic device.

9 Claims, 5 Drawing Sheets

ASSEMBLY FOR SEALING AN AUDIO CONNECTOR WITHIN AN ELECTRONIC DEVICE

FIELD OF THE INVENTION

The present invention relates generally to electrical connectors and more particularly to audio connector assemblies that work to prevent the entry of water into an electronic device.

BACKGROUND

Electrical connectors used with electronic devices such as cellular telephone, radio and MP3 players are typically used for connecting the device to various types of peripheral equipment and accessories. However, water intrusion though these electrical connectors into the device is a major mechanical issue leading to field returns of these products. Prior art FIGS. 1 and 2, illustrate a side sectional view of standard electrical connector assembly 100 where a connector body 101 is used in connection with a housing 103. As best seen in FIG. 1, a dust cover or plug 104 is used to cover the opening in the housing 103 when not in use. A portion of the plug frictionally engages within the opening to prevent entry of dirt, dust, fluids or other airborne debris.

As seen in prior art FIG. 2, when a male connector 105 or other jack is used with the connector body 101, a gap 107 can be created between the body 101 and housing 103. Moreover a space 109 may also open between the connector body 101 and the plug 105. In the event the device were accidentally or intentionally submerged, this will directly expose any internal electronics 111 of the device so as to make the device inoperable.

Those skilled in the art will also recognize that many differing types of connectors have been used which attempt to prevent the entry of liquids into electronic devices. Prior art FIG. 3 illustrates a side sectional view of a connector assembly 200 and its association with the equipment housing. A connector body 201 is typically mounted within a housing 203. A plug or cover 205 is used to seal an aperture 207 between the connector body 201 and the housing 203. The connector body 201 is over-molded so as to create a seal 209 when the connector body is frictionally mounted within the housing 203. One problem associated with this type of configuration is that these types of over molded connectors are costly to manufacture. Moreover, although this over molding process prevents water from contacting internal components through the use of a seal 209, the over molded type of seal has a poor long term reliability especially when submerged in water or other fluids. If the electronic device is intentionally or accidentally submerged, water is likely to breach the seal 209 leading to an inoperative device.

Thus, the problem with many of the approaches used in the prior art is that the connector are not intended to be submerged. Additionally, without an accompanying jack or plug, the opening in the connector will not prevent water from directly entering the electronic device. Accordingly, the need exists to provide a connector which overcomes these shortcomings that will act to prevent the entry of water and other liquids when directly submerged.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
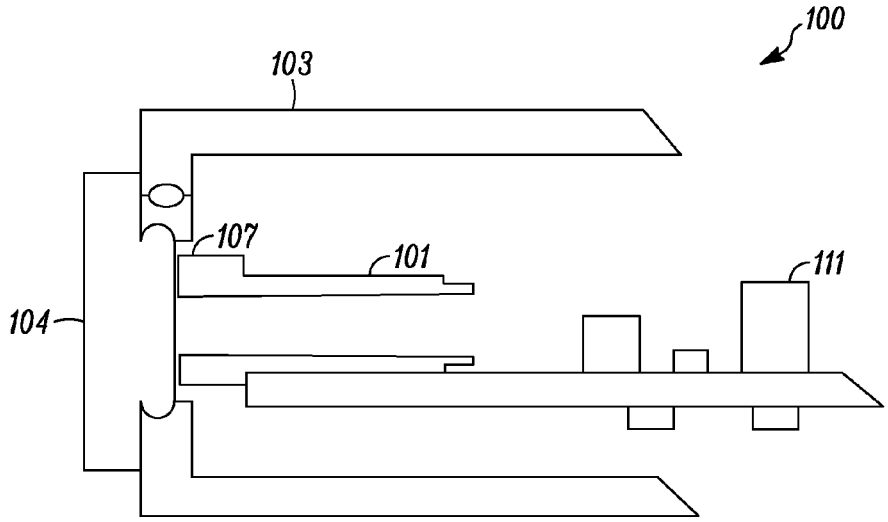
(PRIOR ART) FIG. 1
FIG. 1 and FIG. 2 are side sectional views of an electrical connector as used in the prior art.
Figure 2:
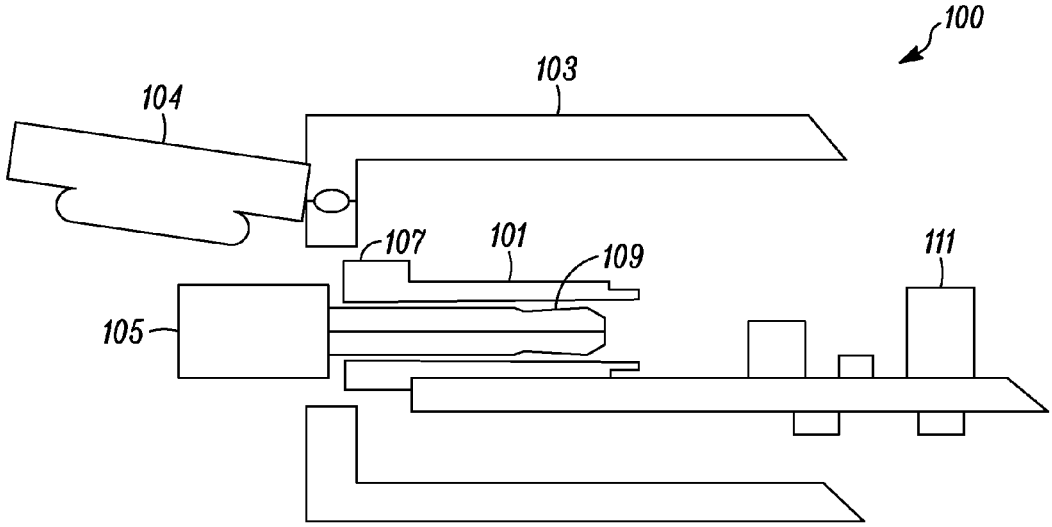
(PRIOR ART) FIG. 2
Figure 3:
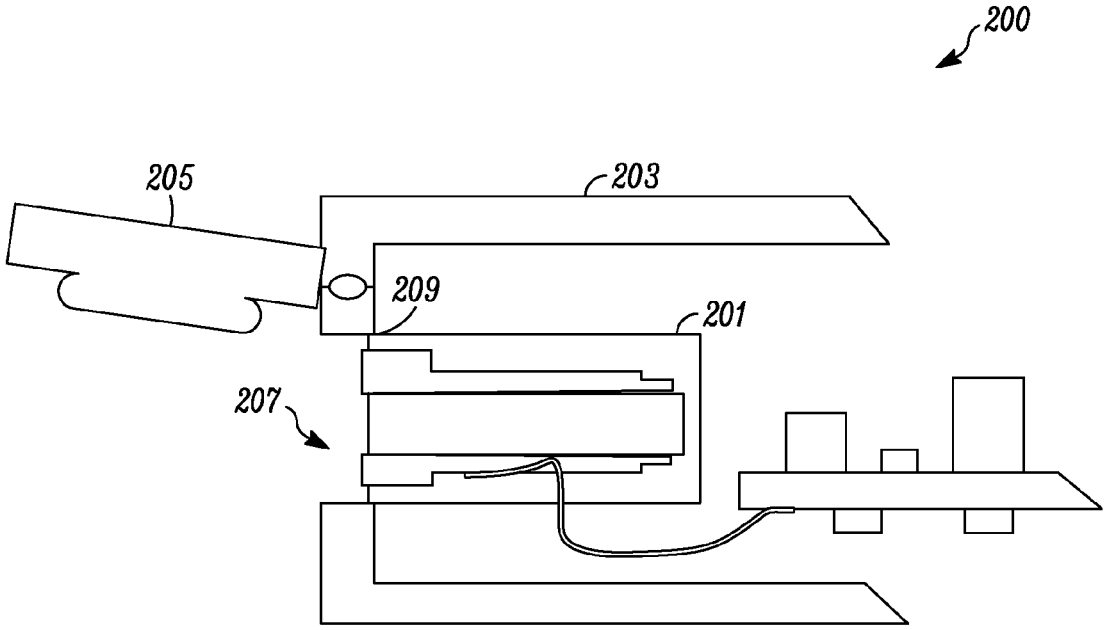
(PRIOR ART) FIG. 3
FIG. 3 is side sectional view of an alternative electrical connector as used in the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a submersible electrical connector assembly. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 4:
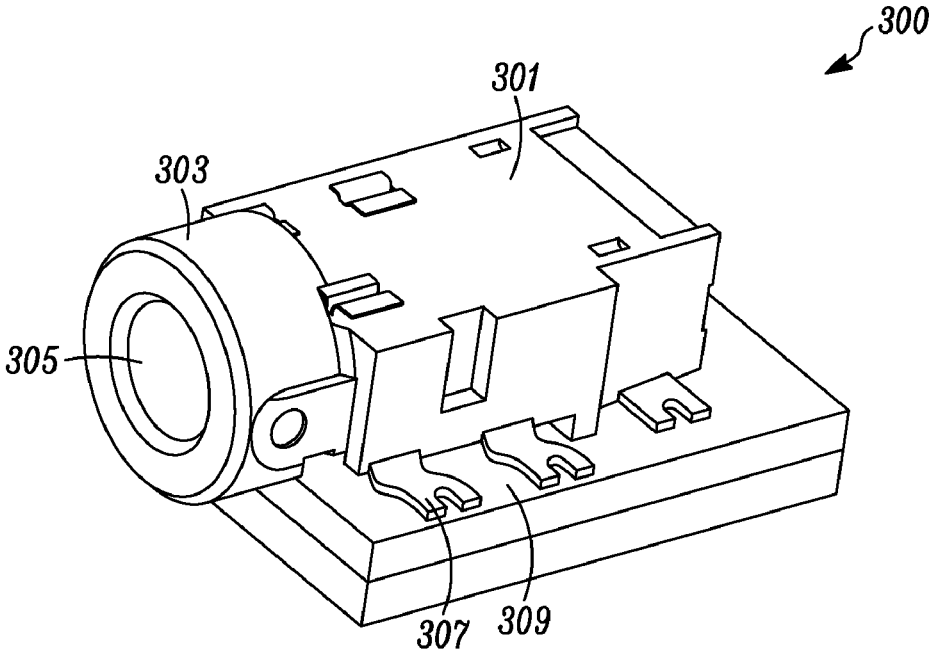
FIG. 4 is a top perspective view of submersible electrical connector assembly in accordance with an embodiment of the present invention.

FIG. 4 is a top perspective view of submersible electrical connector assembly 300 in accordance with an embodiment of the present invention. The electrical connector assembly 300 includes body or housing 301 connected with a cylindrical ring 303 forming an aperture 305. Those skilled in the art will recognize that although the electrical connector as depicted in FIG. 4 is a standard 9 mm connector, commonly used in the industry, any type of printed circuit (PC) mount connector having a similar configuration can be used. The connector assembly further includes one or more solder pads 307 which are electrically connected to traces (not shown) on a substrate 309 which may be standard FR-4 board or the like.

Figure 5:
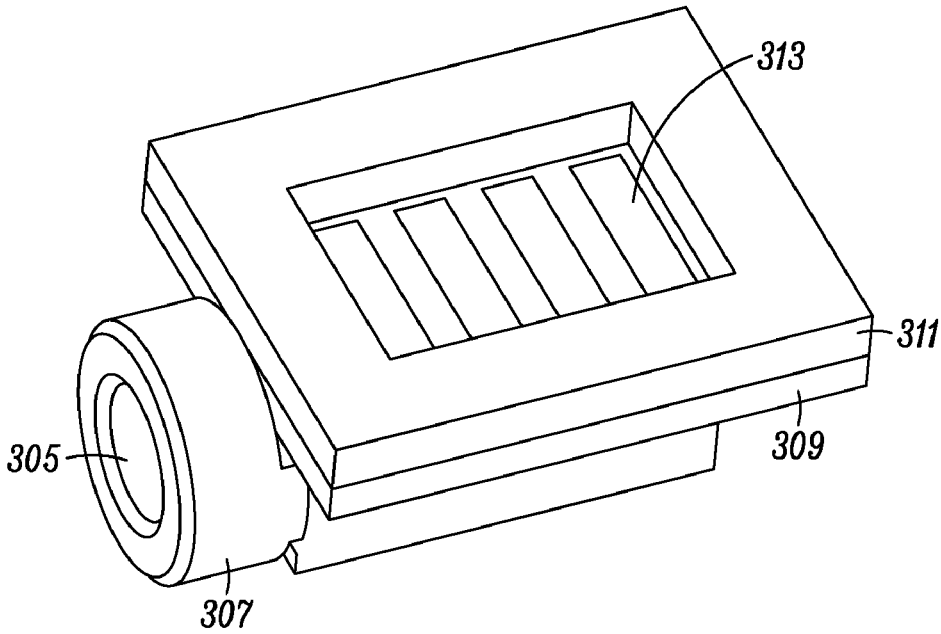
FIG. 5 is a bottom perspective view of the submersible electrical connector assembly as shown in FIG. 4.

FIG. 5 is a bottom perspective view of the submersible electrical connector assembly as shown in FIG. 4. Under the substrate 309, a adhesive type pad 311 is mounted to the surface of the substrate 309. A material having a very high bonding capability is preferable for this type of application. The pad 311 is cut into a configuration allowing access to one or more pads 313 positioned on the substrate 309. As shown herein, contact pins or other electrical connectors may be used to connect the pads 313 to electrical circuitry.

Figure 6:
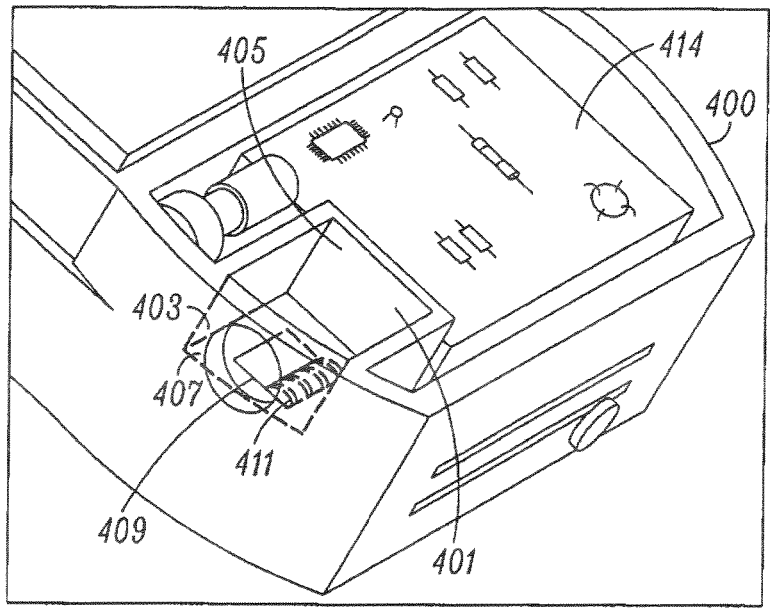
FIG. 6 is a top perspective view of the compartment and aperture used in connection with the submersible electrical connector assembly.

FIG. 6 is a top perspective view of the compartment and aperture used in connection with the submersible electrical connector assembly of the present invention. In order to prevent the entry of water through the connector assembly, an electrical device housing 400 includes a compartment 401 with is configured into a side portion 403 of the housing 400. In this example, the compartment 401 is configured into a substantially cubical like configuration having a plurality of walls 405 surrounding a substantially flat bottom surface 407. An aperture 409 is positioned within the bottom surface 407 which exposes one or more contacts 411 for connecting to pads 313 as seen in FIG. 5. It will be evident to those skilled in the art that any type of flex or zebra strip type connectors can be used to connect with the pad 313 to make an electrical connection.

Figure 7:
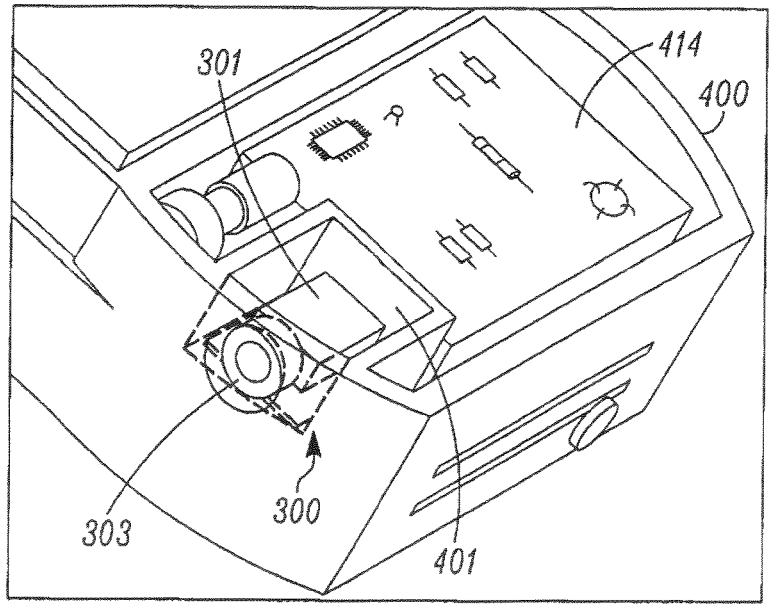
FIG. 7 is a top perspective view of the submersible electrical connector assembly installed in the compartment.

FIG. 7 is a top perspective view of the submersible electrical connector assembly 300 installed in the compartment 401. In this configuration the adhesive 311 is sealed around the aperture 409 such that the connector body 301 and cylindrical ring 303 is positioned so that it faces though the opening in the compartment 401. This allows the user of the device easy access to the submersible electrical connector assembly when connecting a peripheral device or accessory.

Figure 8:
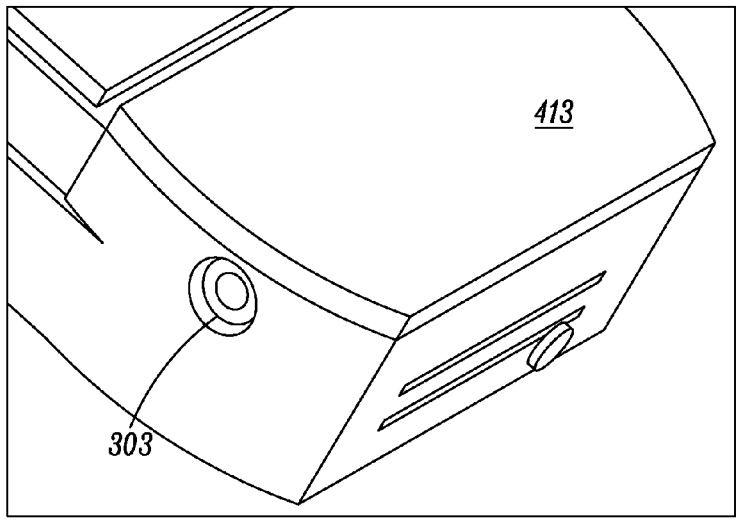
FIG. 8 is a top perspective view of submersible electrical connector assembly with a cover over the cavity and loaded against the assembly.

FIG. 8 is a top perspective view of submersible electrical connector assembly with a cover 413 over the compartment 401 and loaded against the walls 405 and bottom surface 407. The cover 413 works to isolate the housing 301 and provide an attractive fit and finish for the device. Those skilled in the art will recognize that the cover 413 is not intended to seal the compartment 401 but merely acts as a cover to protect against dust or other debris from contacting the electrical connector assembly 300.

Figure 9:
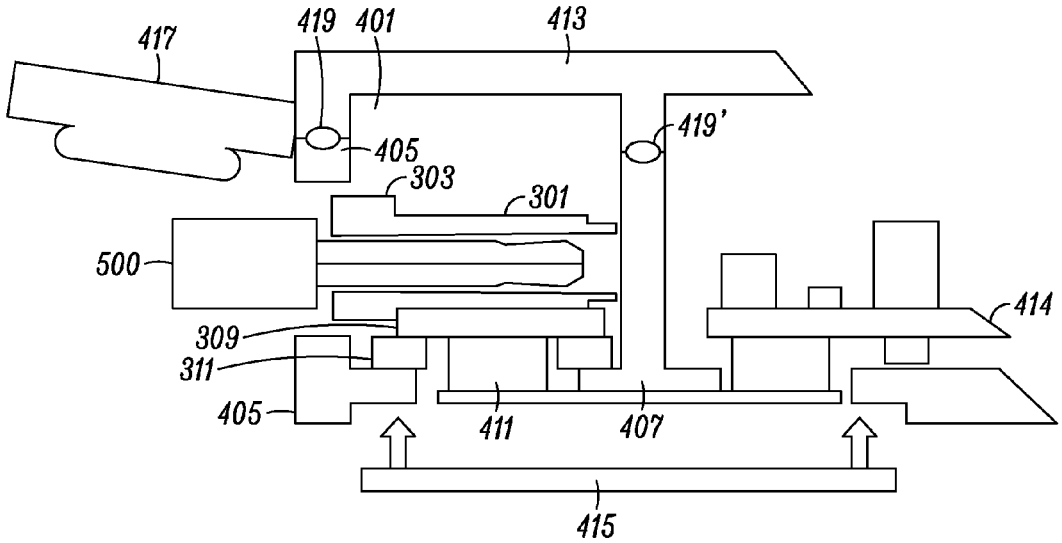
FIG. 9 is a side sectional view of the submersible electrical connector assembly as shown in FIG. 4 with a male connector inserted in the assembly.

Finally, FIG. 9 is a side sectional view of the submersible electrical connector assembly as shown in FIGS. 6-8. The side sectional view illustrates the compartment 401 formed with the walls 405 and bottom surface 407. With a male connector 500 connected within the housing 301, even if the device were submerged in water, the water can enter the compartment 401 but would be prevented from entering the aperture 409 in view of the sealed connection between the adhesive pad 311 and the surface 407. This acts to prevent water contacting either contact 411 or electrical components 414. In addition, a perimeter seal 415 works to prevent water from entering around the perimeter of the housing of the electronic device. When the male connector 500 is removed, then the plug 417 can be reinserted in the aperture formed in the side portion 403. A cover seal 419, 419' is also shown which acts to prevent water from entering the compartment 401 under the dust cover 413.

Thus, the present invention takes an off the shelf connector assembly and places it into a separate carrier board. The carrier board contains contacts pads opposite to the connector. An adhesive pad is used to attached this subassembly to the sealed radio. A cover is then placed over the subassembly for keeping the adhesive pad sealed to the radio. Contact is made to the subassembly via a standard compression connector (z-axis pad or battery style contacts). Although water is allowed to enter the electrical device housing, the water will not breach the housing of the device allowing the water to effect internal electronics.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. An assembly for sealing an electrical connector within an electronic device comprising:

at the electrical connector:

a standard electrical connector having an audio jack for receiving a male connector, the standard electrical connector mounted to one side of a printed circuit board (pcb);

an adhesive pad coupled to an opposing side of the pcb, the adhesive pad formed of a pliable material acting as a seal surrounding a plurality of electrical pads located on the opposing side of the pcb, the pads being electrically coupled to the electrical connector; and at the electronic device:

a compartmentalized area configured into a side portion of the electrical device, the compartmentalized area formed of side walls and a bottom surface for receiving the electrical connector, the bottom surface having an aperture formed therein for exposing contacts of the electronic device, the contacts of the electronic device making electrical contact with the electrical pads of the electrical connector while the adhesive pad provides a seal around the aperture thereby allowing fluid to enter the compartmentalized area and audio jack while preventing fluid from entering the electronic device.

2. An assembly for sealing an electrical connector within an electronic device as in claim 1, wherein the compartmentalized area formed of side walls and bottom surface leave access to the audio jack from the side of the electronic device and allow access to the compartmentalized area from the electronic device's back.

3. An assembly for sealing an electrical connector within an electronic device as in claim 2, further comprising:

a cover for enclosing the electronic device's compartmentalized area while leaving access to the audio jack.

4. An assembly for sealing an electrical connector within an electronic device as in claim 3, further comprising: a flex connector connecting the electrical pads of the pcb to the contacts of the electronic device.

5. An assembly for sealing an electrical connector within an electronic device as in claim 1, wherein the wherein the electronic device comprises a two-way radio.

6. An electrical device having a submersible audio connector assembly comprising:

an electrical device housing having a side compartment for receiving an audio jack, the audio jack mounted to a substrate having electrical pads coupled to the audio jack, the side compartment having an aperture exposing electronic contacts of the electronic device, the electronic contacts being coupled to the electrical pads of the audio jack; and an adhesive pad coupled within the side compartment between the substrate around the aperture Of the electronic device, the adhesive pad forming a seal around the electrical pads coupled to the electrical contacts.

7. The electronic device of claim 6, wherein upon submersion of the audio connector assembly into fluid, the fluid enters the compartment but is sealed from the electronic device.

8. The electronic device of claim 6, wherein the substrate is a printed circuit board (PCB).

9. The electronic device of claim 6, further comprising a male connector coupled into the audio jack, wherein the compartment, audio jack and male connector are submersible while the electronic contacts of the electronic device remain sealed.

* * * * *